US005920025A

United States Patent [19]

Itoh et al.

[11] Patent Number: 5,920,025

[45] Date of Patent: Jul. 6, 1999

[54] AUTOMATIC ACCOMPANYING DEVICE AND METHOD CAPABLE OF EASILY MODIFYING ACCOMPANIMENT STYLE

[75] Inventors: Shinichi Itoh; Masao Ishibashi, both of Hamamatsu, Japan

[73] Assignee: Yamaha Corporation, Japan

[21] Appl. No.: 09/003,160

[22] Filed: Jan. 6, 1998

[30] Foreign Application Priority Data

Jan. 9, 1997 [JP] Japan ..... 9-002390

[51] Int. Cl.[6] ..... G10H 1/40

[52] U.S. Cl. ..... 84/611; 84/635; 84/DIG. 12

[58] Field of Search ..... 84/611, 612, 635, 84/636, DIG. 12

[56] References Cited

U.S. PATENT DOCUMENTS 4,872,385 10/1989 Oguri et al. ..... 84/635
5,369,217 11/1994 Yamashita et al. ..... 84/611

FOREIGN PATENT DOCUMENTS 2-131292 5/1990 Japan .

*Primary Examiner*—Stanley J. Witkowski
*Attorney, Agent, or Firm*—Rossi & Associates

[57] ABSTRACT

Separately from an accompaniment style data memory having stored therein one or more accompaniment style data each including performance data for an automatic accompaniment, a modifying data memory is provided which has stored therein one or more modifying data sets each including style designating data for designating any of the accompaniment style data stored in said accompaniment style data memory and modification instructing data for modifying contents of the accompaniment style data designated by the style designating data. Desired one of the modifying data sets is selected and read out from the modifying data memory. One of the accompaniment style data is read out from the accompaniment style data memory in response to the style designating data of the read-out modifying data set read out by said readout section and its contents are modified in accordance with the modification instructing data of the read-out modifying data set, so as to generate modified accompaniment style data. When the modification instructing data indicates a modification for a performance time longer than one pattern cycle of the designated accompaniment style data, the designated accompaniment style data is repetitively reproduced to provide time-length-expanded accompaniment style data, and the time-length-expanded accompaniment style data is then subjected to modification in accordance with the modification instructing data.

12 Claims, 7 Drawing Sheets

AUTOMATIC ACCOMPANYING DEVICE AND METHOD CAPABLE OF EASILY MODIFYING ACCOMPANIMENT STYLE

BACKGROUND OF THE INVENTION

The present invention relates generally to automatic accompanying devices for executing an automatic accompaniment on the basis of accompaniment style data including performance data, and more particularly to an improved automatic accompanying device and method capable of generating desired modifications of accompaniment style data with utmost ease.

Of various automatic accompanying devices, there have been known ones which can modify numerous preset (i.e., existing) accompaniment style data to provide modified (variation of) accompaniment style data as desired by a user. In some of such modifying-type automatic accompanying devices, a set of modifying data is prestored for each of the accompaniment style data in order to provide modified accompaniment style data. The modifying data has a time length equal to or greater than that of the preset or existing accompaniment style data; usually, the modifying data has a one-measure length.

However, the conventional modifying-type automatic accompanying devices would present the following problems because the modifying data is prestored for each of the existing accompaniment style data so that the preset accompaniment style data and the modifying data are handles together as a unit. Namely, when two different modified accompaniment style data are to be made from one of the existing accompaniment style data, the existing accompaniment style data has to be copied into a storage area usable by a user (user-style storage area) to prepare two sets of the same existing accompaniment style data, which results in the copied data quantity becoming twice as large as that of the existing or original accompaniment style data and occupying a great part of the user-style storage area. Further, because only three different accompaniment style data, i.e., the original accompaniment style data and first and second modified accompaniment style data, are obtained due to the limited capacity of the storage area, it is not possible to provide an automatic accompaniment full of variety. In other words, with the known modifying-type automatic accompanying devices, the original accompaniment style data can not be modified effectively without requiring a great part of the storage area.

In addition, due to the fact that creation of a long accompaniment style data set inevitably involves a considerable increase in data quantity and prevents efficient use of the storage area, the conventional modifying-type automatic accompanying devices can only create short accompaniment style data. Thus, in performance, the devices can only reproduce such short accompaniment style data in a repetitive manner, which would result in a monotonous accompaniment; thus, the devices could not achieve accompaniments full of variety.

SUMMARY OF THE INVENTION

It is therefore an object of the present invention to provide an automatic accompanying device and method which can generate modified accompaniment style data while minimizing an increase in data quantity, to thereby permit creation of long accompaniment style data and hence accompaniment full of variety.

According to an aspect of the present invention, there is provided an automatic accompanying device which comprises: an accompaniment style data storage section having stored therein one or more accompaniment style data each including performance data for an automatic accompaniment; a modifying data storage section having stored therein one or more modifying data sets each including style designating data for designating any one of the accompaniment style data stored in the accompaniment style data storage section and modification instructing data for modifying contents of the accompaniment style data designated by the style designating data; a readout section that reads out one of the modifying data sets from the modifying data storage section; and an accompaniment style data generation section that reads out one of the accompaniment style data in response to the style designating data included in the modifying data set read out by the readout section and modifies contents of the read-out accompaniment style data in accordance with the modification instructing data included in the read-out modifying data set, so as to generate modified accompaniment style data.

The modifying data set prestored in the modifying data storage section only includes style designating data for designating any one of the accompaniment style data to be modified and modification instructing data for modifying contents of the accompaniment style data designated by the style designating data, and it is not necessary to contain accompaniment style data including performance data for an automatic accompaniment. Because previously-made accompaniment style data itself need not be stored in the modifying data storage section, it is possible to save an available area in the modifying data storage section. As a result, a number of modified accompaniment style data can be readily made from a single previously-made accompaniment style data using only a small storage area.

According to a second aspect of the present invention, there is provided an automatic accompanying device which comprises: an accompaniment style data storage section having stored therein one or more accompaniment style data each including performance data for an automatic accompaniment; a modifying data storage section having stored therein one or more modifying data sets each including style designating data for designating any one of the accompaniment style data stored in the accompaniment style data storage section and modification instructing data for modifying contents of the accompaniment style data designated by the style designating data; a readout section that reads out one of the modifying data sets from the modifying data storage section; and an accompaniment style data generation section that reads out one of the accompaniment style data in response to the style designating data included in the modifying data set read out by the readout section and modifies contents of the read-out a accompaniment style data in accordance with the modification instructing data included in the read-out modifying data set so as to generate modified accompaniment style data, wherein when the modification instructing data indicates a modification for a performance time longer than one pattern cycle of the designated accompaniment style data, the designated accompaniment style data is repetitively reproduced to provide time-length-expanded accompaniment style data, and the time-length-expanded accompaniment style data is subjected to modification in accordance with the modification instructing data so that the modified accompaniment style data is generated in time-length-expanded form.

One pattern cycle of previously-made accompaniment style data, of course, has a limited time length. To permit free modification of the accompaniment style data, it is desirable to freely set the time length of one pattern cycle of the accompaniment style data. In cases where the time length of one pattern cycle of the original accompaniment style data to be modified is smaller than that of modified accompaniment style data to be derived from the original accompaniment style data in accordance with the modification instruction data, it matters what kind of modifying process is to be allowed. One example of the cases may be where the time length of one pattern cycle of the original accompaniment style data to be modified is the length of two measures while the time length of one pattern cycle of modified accompaniment style data to be derived from the original accompaniment style data in accordance with the modification instruction data is the length of four measures. To deal with such a situation, the second aspect of the present invention, when the modification instructing data indicates a modification for a performance time longer than one pattern cycle of the designated accompaniment style data, repetitively reproduce the designated accompaniment style data over a necessary number of pattern cycles to thereby generate time-length-expanded accompaniment style data. This time-length-expanded accompaniment style data is then subjected to modification in accordance with the modification instructing data so that the modified accompaniment style data is generated in time-length-expanded form. In this way, different kinds of modifying process can be performed on first and second pattern cycles of the original accompaniment style data, and consequently time-length-expanded accompaniment style data can be generated with complicated accompaniment pattern.

According to a third aspect of the present invention, there is provided an automatic accompanying device which comprises: an accompaniment style data storage section having stored therein one or more accompaniment style data each including performance data for an automatic accompaniment; a modifying data storage section having stored therein one or more modifying data sets each including style designating data for designating one or more of the accompaniment style data stored in the accompaniment style data storage section and modification instructing data for modifying contents of the accompaniment style data designated by the style designating data; a readout section that reads out one of the modifying data sets from the modifying data storage section; and an accompaniment style data generation section that reads out the first accompaniment style data in response to the style designating data included in the modifying data set read out by the readout section and modifies contents of the read-out first accompaniment style data in accordance with the modification instructing data included in the read-out modifying data set so as to generate modified accompaniment style data, wherein when the modification instructing data indicates a modification for a performance time longer than one pattern cycle of the designated accompaniment style data, one or more second accompaniment style data are further read out from the accompaniment style data storage section in response to the style designating data and the first and second accompaniment style data are coupled together to provide time-length-expanded accompaniment style data, and the time-length-expanded accompaniment style data is subjected to modification in accordance with the modification instructing data so that the modified accompaniment style data is generated in time-length-expanded form.

With such an arrangement, time-length-expanded accompaniment style data can be made by coupling together any necessary number of accompaniment style data without monotonous repetition of the same accompaniment style data, and the time-length-expanded accompaniment style data can be modified in accordance with the modification instructing data. As a result, modified accompaniment style data in time-length-expanded can be generated with even more complicated accompaniment pattern.

According to a fourth aspect of the present invention, there is provided an automatic accompanying device which comprises: an accompaniment style data storage section having stored therein a plurality of accompaniment style data each including performance data for an automatic accompaniment; a modifying data storage section having stored therein a plurality of modifying data sets each including style designating data for designating one or more of the accompaniment style data stored in the accompaniment style data storage section and modification instructing data for modifying contents of the accompaniment style data designated by the style designating data; a first selecting operation section that selects any one of the accompaniment style data stored in the accompaniment style data storage section; a second selecting operation section that selects any one of the modifying data sets stored in the modifying data storage section; a readout section that reads out one of the modifying data sets selected via the second selecting operation section from the modifying data storage section; and an accompaniment style data generation section that reads out the first accompaniment style data in response to the style designating data included in the modifying data set read out by the readout section and modifies contents of the read-out first accompaniment style data in accordance with the modification instructing data included in the read-out modifying data set, so as to generate modified accompaniment style data.

By properly using the first selecting operation section and second selecting operation section depending on the case, it is possible to freely select both desired original accompaniment style data stored in the accompaniment style data storage section and desired modified accompaniment style data. As a result, an easy and free selection can be made from a variety of automatic accompaniment patterns, even with a very simple arrangement.

It is also important to note that the inventive concepts of the present invention as will be detailed hereinbelow can be embodied as not only a device but also a method. The present invention can also be embodied in the form of a computer program and a recording medium storing thereon such a computer program.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
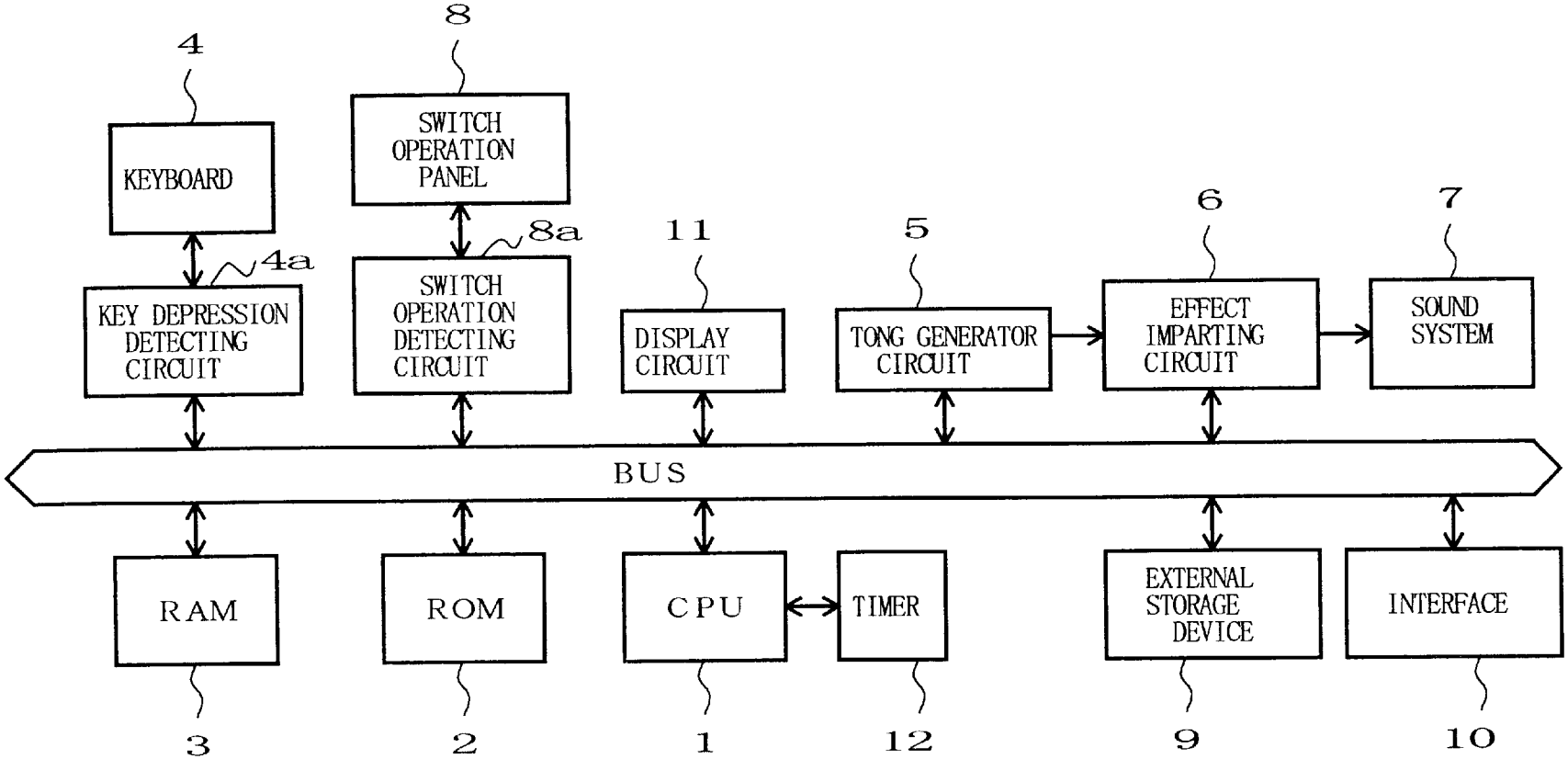
FIG. 1 is a block diagram of an electronic musical instrument to which is applied the present invention.

FIG. 1 is a block diagram of an electronic musical instrument to which is applied the present invention. CPU 1 controls overall operations of the electronic musical instrument on the basis of control programs prestored in a ROM 2, using a working area of a RAM 3. During performance, a key depression detecting circuit 4*a* detects a key code, key-on signal, etc. from a keyboard 4, a tone generator circuit 5 generates a tone signal on the basis of the key code, key-on signal, etc., and an an effect imparting circuit 6 imparts a tonal effect to the generated tone signal. The tone signal with the effect imparted thereto is audibly reproduced or sounded via a sound system 7. The tone generator circuit 5 is capable of simultaneously generating a plurality of tones through time-divisional multiplex processing in a plurality of tone generating channels, and thereby it provides for an ensemble of a plural-part automatic accompaniment and keyboard performance. The keyboard 4 is not necessarily essential, and a key code, key-on signal, etc. may be generated by operation of predetermined switches provided on an switch operation panel 8.

During an automatic accompaniment, a played chord is detected from a chord key region (e.g., left key region) on the keyboard 4, and accompaniment style data preset in the ROM 2 or RAM 3 is read out in accordance with a currently selected accompaniment style. If a selection is made of modifying data prestored in the RAM 3 or external storage device 9, the accompaniment style data is modified on the basis of the modifying data to thereby provide modified accompaniment style data. The automatic accompaniment data is carried out on the basis of the modified accompaniment style data.

Various switches are provided on the switch operation panel 8, and the CPU 1 detects each operation event on the panel 8 by means of a switch operation detecting circuit 8*a* and executes operations corresponding to the individual detected operation events, which include operations for selecting a tone color of a performance on the keyboard 4, for starting/stopping an automatic accompaniment, and saving modified accompaniment style data or modifying data into the external storage device 9. The CPU 1 also executes an operation for inputting accompaniment style data, etc. supplied from an external instrument via an interface 10.

Display unit 11 includes a liquid crystal display (LCD) panel, which visually presents screen switches and a cursor for GUI (Graphical User Interface). By moving the cursor and activating any of the screen switches through user's operation on the switch operation panel 8, the user is allowed to execute entry operations for selecting from among the existing accompaniment style data and modifying data and give unique names to the individual modifying data.

Timer 12 generates interrupt signals at timing corresponding to tempo information set by the CPU 1 and resolution of accompaniment data contained in accompaniment style data (e.g., for every 384th note), and in response to each of the interrupt signals, the CPU 1 carries out an interrupt process to control an automatic accompaniment.

Figure 2:
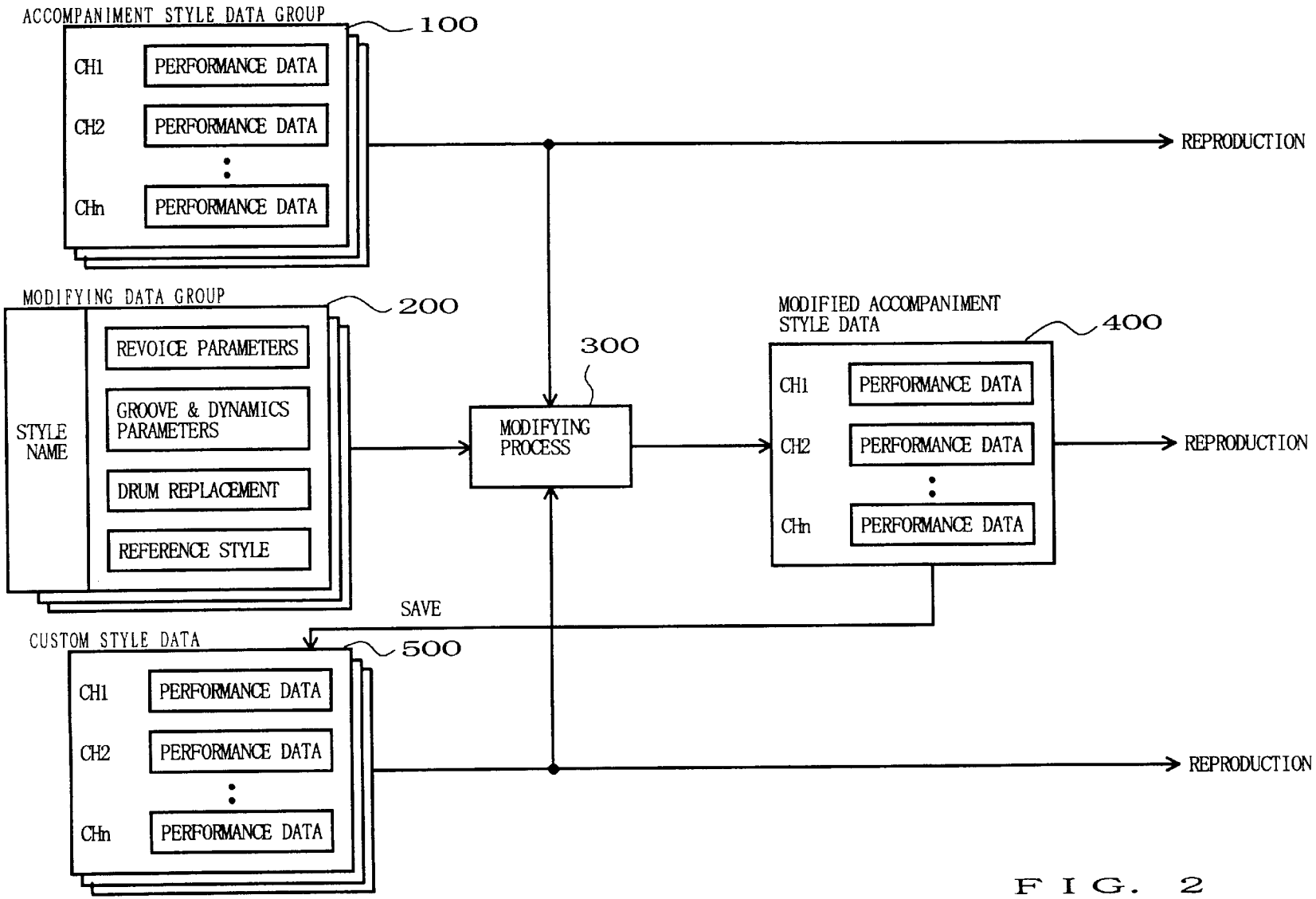
FIG. 2 is a functional block diagram showing a configuration of a first embodiment in terms of its essential functions.

FIG. 2 is a functional block diagram of a first embodiment of the present invention in terms of its essential functions, which are implemented by the storage functions of the ROM 2, RAM 3 and external storage device 9 and the function performed by the CPU 1 on the programs stored in the ROM 2 using the working area of the RAM 2. Accompaniment style data group 100 comprises a plurality of existing accompaniment style data preset in the ROM 2 and existing accompaniment style data stored in the RAM 3 or external storage device 9 (normally, custom style data), and each of the accompaniment style data includes performance data of plural channels CH1 to CHn corresponding, for example, to automatic accompaniment tracks.

Modifying data group 200 comprises, for example, one or plural sets (in the illustrated example, plural sets) of data read out from the external storage device 9 into the RAM 3 or data newly generated in the RAM 3. Each set of the modifying data includes "style name" data optionally settable by a user, and also includes various modification instructing parameters and data such as "revoice parameters", "groove and dynamics parameters" and "drum replacement" as well as style instructing data "reference style".

The "revoice parameters" are for instructing changes of settings, such as tone color, in the individual tracks and include parameters such as "voice number change", "volume change", "reverbe", "chorus change" and "pan change".

The "groove and dynamics parameters" are for setting velocity, time gate and tone generation timing in accordance with predetermined rules to produce a kind of delicate "groove". To set such "groove" parameters, a plurality of templates (groove templates) determining rules of velocity, time gate and tone generation timing for one or more measures are stored as preset data so that any of the templates is selectively set as desired by the user. Note that the individual parameter values of the selectively set groove template can be modified as desired. As will be later described, the "dynamics" parameters are for dynamically changing a magnitude of velocity.

The "drum replacement" data is for instructing a replacement of drum tone color, for example, from "snare" to "cowbell".

The "reference style" data is for designating specific accompaniment style data to be modified from among the preset or existing accompaniment style data group 100 and custom style data 500.

Further, in FIG. 2, a modifying process 300, which is initiated upon start of an automatic accompaniment, reads out specific reference style data of specific modifying data selected from among the modifying data group 200 and then reads out specific accompaniment style data corresponding to the specific reference style data from among the accompaniment style data group 100, so as to modify the read-out accompaniment style data on the basis of the above-mentioned various modification instructing parameters and data included in the modifying data. The resultant modified accompaniment style data 400 is then reproduced, or saved as custom style data 500 into the external storage device 9 (e.g., hard disk) if the saving is instructed, for example, through user's operation on the switch operation panel 8. Selection of the modifying data is made through user's operation on the liquid crystal display panel of the display unit 11, and the contents of the selected modifying data can also be edited, through user's operation on the liquid crystal display panel, so as to allow the modifying process to be executed in a manner as desired by the user.

When desired accompaniment style data is selected from among the existing accompaniment style data group 100 and start of an automatic accompaniment is instructed, an automatic accompaniment based on the selected accompaniment style data is reproduced in the conventional manner. In addition, an automatic accompaniment can be reproduced on the basis of the custom style data 500 saved in the external storage device 9, and the contents of the saved custom style data 500 can also be modified as desired. In the illustrated example, the modifying data "reference style" designates the custom style data 500.

Figure 3A:
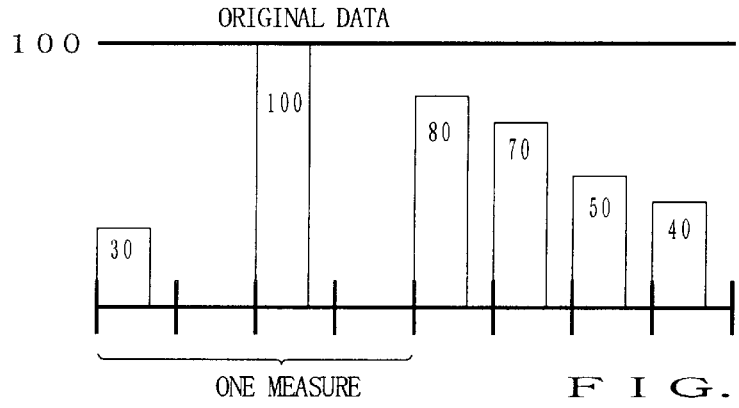
FIGS. 3A to 3C are diagrams conceptually showing a manner in which velocity is modified using dynamics parameters.
Figure 3B:
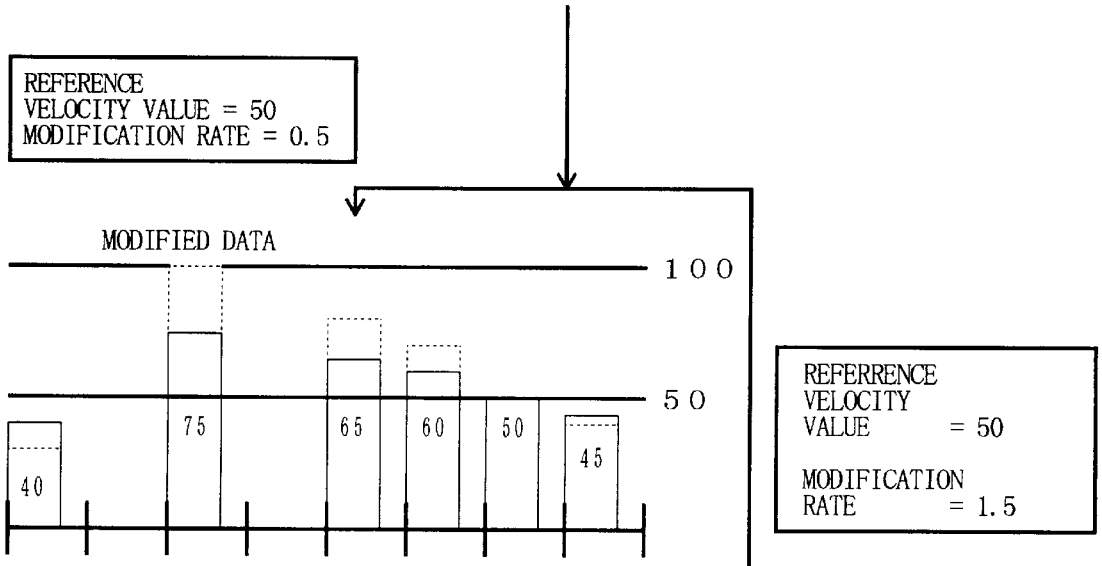
Figure 3C:
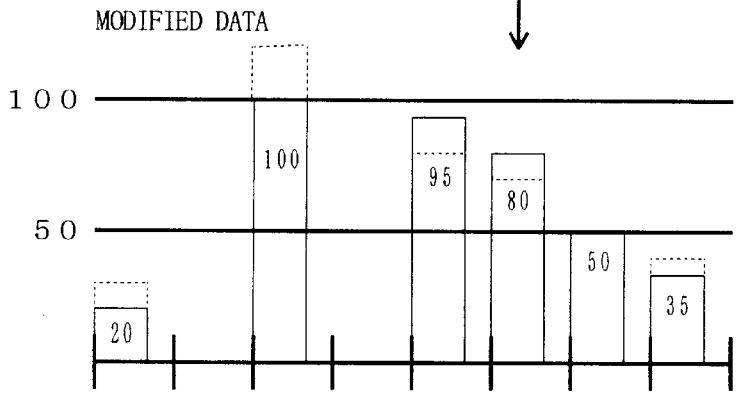

FIGS. 3A to 3C are diagrams conceptually showing a manner in which velocity is modified using the dynamics parameters. In FIG. 3A, original data (velocity data in accompaniment style data) is shown where a first tone has a velocity value of "30", a second tone has a velocity value of "100", and third to sixth tones have velocity values of "80", "70", "50"and "40", respectively. In this example, the maximum velocity value is set at "100" while the minimum velocity value is set at "1", so that velocity values greater than "100" are rounded down to the maximum "100" and velocity values smaller than "0" are rounded up to the minimum "1".

Here, modifying parameters are a reference velocity value and a modification rate. FIG. 3B shows an example where the reference velocity value is set at "50" and the modification rate is set at "0.5", and FIG. 3C shows another example where the reference velocity value is set at "50" and the modification rate is set at "1.5". For instance, the modification rate is a value that may be variably set within a range of 0–2. Velocity modification value is determined by multiplying a difference of a velocity value from the reference velocity value ("velocity value"–"reference velocity value"), and a modified velocity value is determined by adding the velocity modification value to the reference velocity value. Such a reference velocity value and modification rate are set as dynamics parameters of the modifying data, so as to modify the velocity value of the corresponding accompaniment style data.

Figure 4:
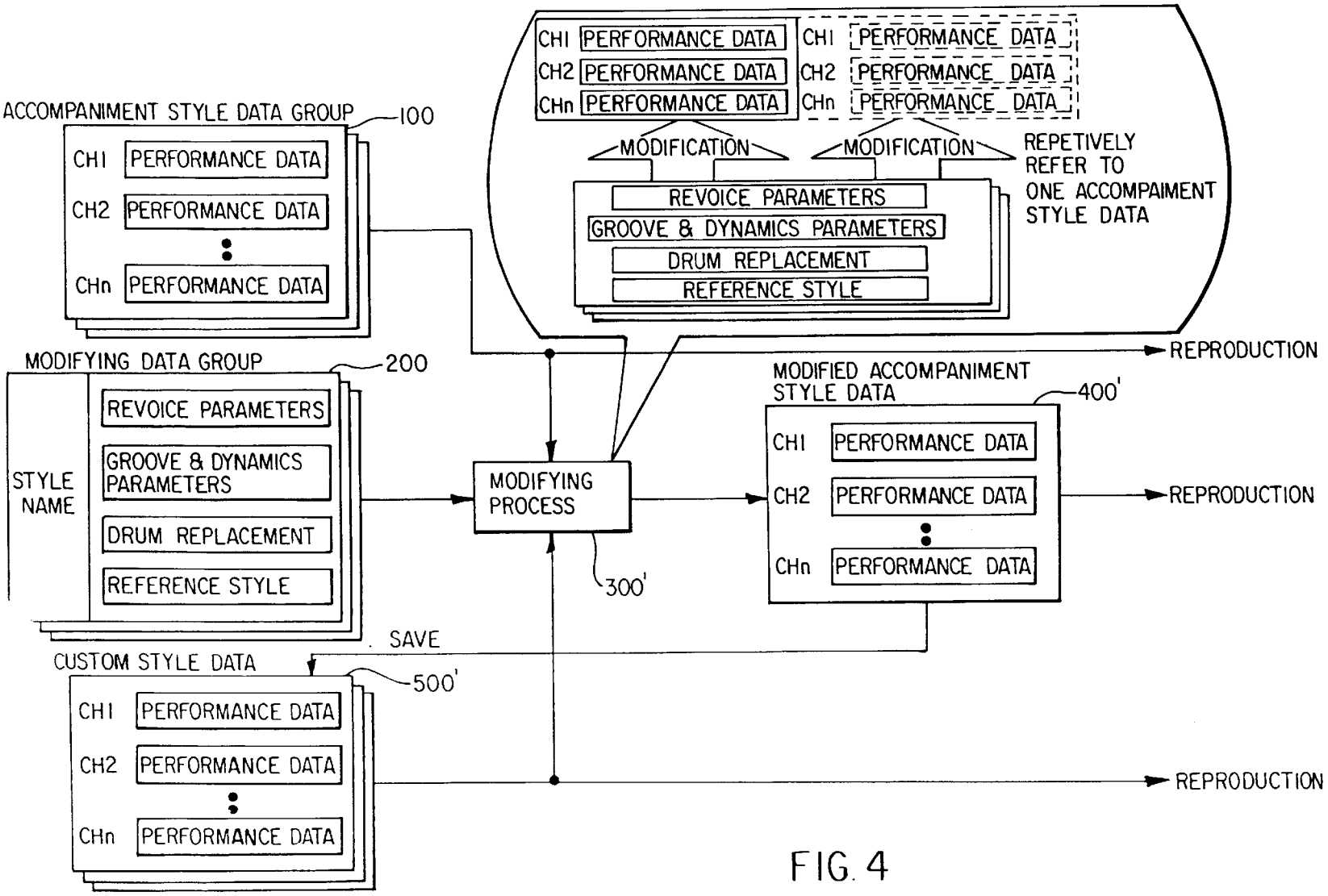
FIG. 4 is a functional block diagram showing a configuration of a second embodiment of the present invention.

FIG. 4 is a functional block diagram showing a configuration of a second embodiment of the present invention, which is implemented by the functions of the CPU 1, ROM 2, RAM 3 and external storage device 9 as in the above-described first embodiment and where the accompaniment style data group 100 is the same as that in the first embodiment. The second embodiment is shown here as being applied to a case where modifying data selected from among the modifying data group 200 designates a time-series length greater than that of the corresponding accompaniment style data, e.g., a case where the number of measures to be modified is specified and the specified number of measures represents a time length greater than that of the corresponding accompaniment style data.

More specifically, in the case where the length specified by the selected modifying data is greater than that of the accompaniment style data corresponding to the reference style, a modifying process 300', upon completion of modification operations of the accompaniment style data, again reads out and modifies the same accompaniment style data for successive reproduction. As a result, modified accompaniment style data 400' is provided which is longer than the original accompaniment style data. Note that the modified accompaniment style data 400' can also be saved as custom style data 500' into the external storage device 9.

Figure 5:
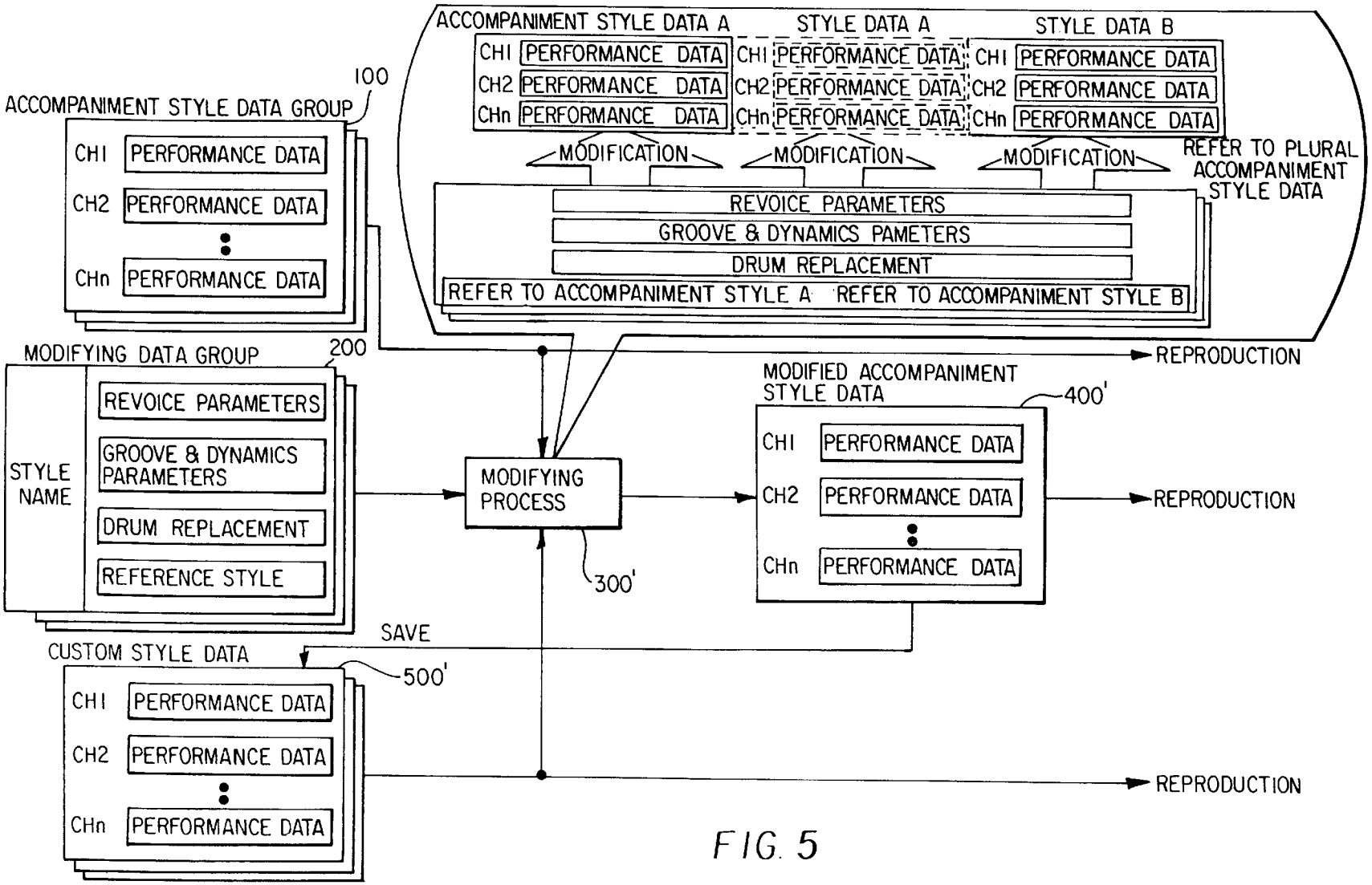
FIG. 5 is a functional block diagram showing a configuration of a third embodiment of the present invention.

FIG. 5 is a functional block diagram showing a configuration of a third embodiment of the present invention, which is implemented by the functions of the CPU 1, ROM 2, RAM 3 and external storage device 9 as in the above-described first and second embodiments and where the accompaniment style data group 100 is the same as those in the first and second embodiments. In this third embodiment, the "reference style" data in the modifying data 200 designates a plurality of accompaniment style data, and a modifying process 300" modifies these plural accompaniment style data. For example, the modifying process 300" modifies accompaniment style data A two times in succession and then modifies another accompaniment style data B once, as shown in FIG. 5. As a result, modified accompaniment style data 400", comprising a combination of plural modified accompaniment style data, is provided which has a great time length and is full of variety. The modified accompaniment style data 400" can also be saved as custom style data 500" into the external storage device 9.

Figure 6:
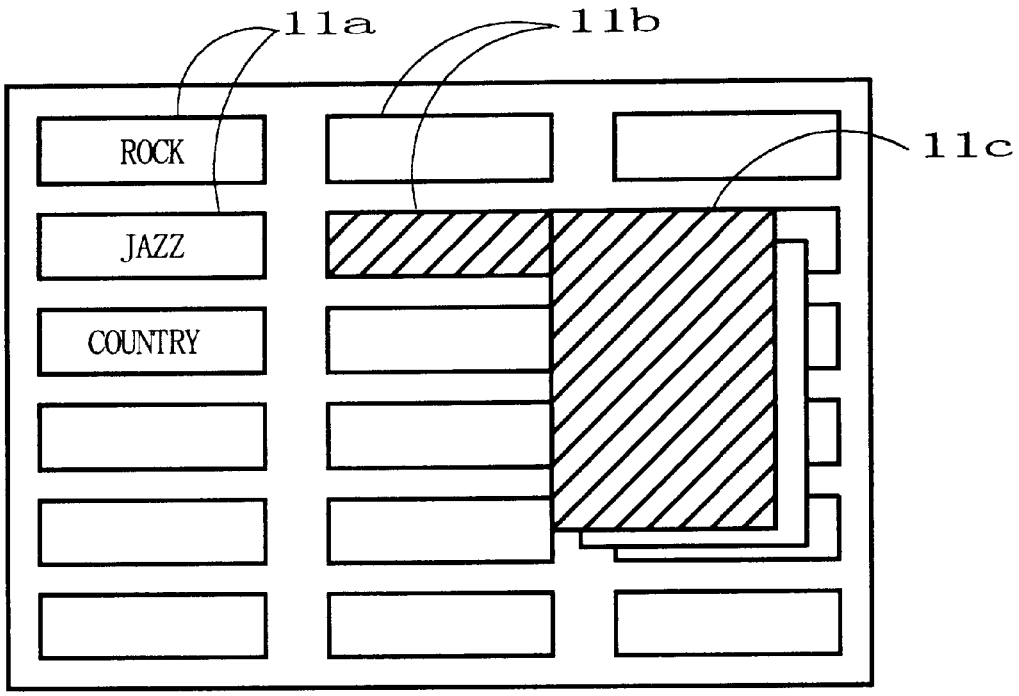
FIG. 6 is a diagram showing an example of a picture presented on a liquid crystal display panel of a display unit in a fourth embodiment of the present invention.

FIG. 6 is a diagram showing an example of a picture presented on the liquid crystal display panel of the display unit 11 in a fourth embodiment of the present invention. In this picture, there are shown existing-accompaniment-style selecting operators (screen switches) lia that are provided in corresponding relations to the existing accompaniment style data and modifying-data selecting operators (screen switches) 11*b* for selecting a modifying data set. Further, preset style names or user-set style names are also shown in association with the existing-accompaniment-style selecting operators 11*a* and modifying-data selecting operators 11*b*. By turning on a predetermined setting switch (not shown) after placing a cursor (e.g., inverted display) on a specific one of the existing-accompaniment-style selecting operators 11*a*, one of the existing accompaniment style data can be selected for an automatic accompaniment. By turning on the setting switch after placing the cursor on a specific one of the modifying-data selecting operators 11*b*, a menu box lid appears, as shown in the figure, so that a mode to permit generation, editing, registration or the like of modifying data is set. Entry of various data and instructions through such user's screen operation may be implemented in the conventionally-known manner and therefore will not be described in detail here.

Figure 7:
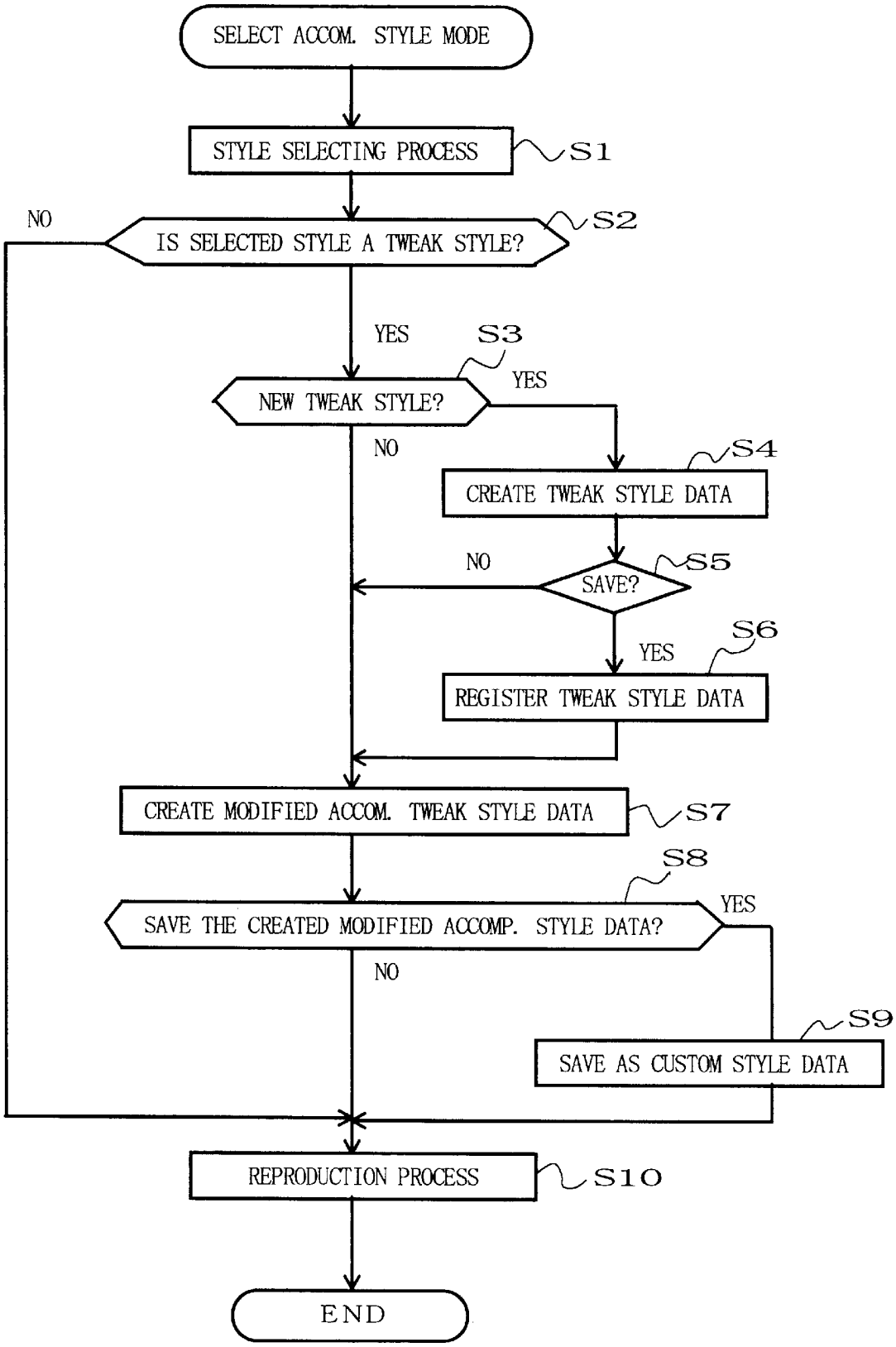
FIG. 7 is a flowchart showing processing in an accompaniment style mode where data and instructions are entered and set in the fourth embodiment.

FIG. 7 is a flowchart showing processing in an accompaniment style mode where data and instructions are entered and set in the fourth embodiment. More specifically, this accompaniment style mode processing is carried out by the CPU 1 in response to user's operation on the liquid crystal display screen of the display unit 11 or on the switch operation panel 8. Note that the fourth embodiment is designed to handle each of the modifying data sets as a "style" like the accompaniment style data, and each of the modifying data sets will hereinbelow be referred to as a "tweak style".

In response to selection of the accompaniment style mode, the CPU 1 executes a style selecting process at step S1. The style selecting process normally monitors input operation by the user, and in response to an interrupt signal received while there is no input from the user, this process of course executes operations corresponding to the interrupt signal. Once one of the styles is selected, a determination is made at step S2 as to whether the selected style is a tweak style. If the selected style is not a tweak style, it means that one of the existing accompaniment style data has been selected, the CPU 1 jumps to step S10 to execute a reproduction process and then terminates the accompaniment style mode processing.

If the selected style is a tweak style as determined at step S2, it is further determined at next step S3 whether the selected style is a new tweak style. If so, the CPU 1 goes to step S4, but if not, the CPU 1 moves to step S7. The CPU 1 generates data of the selected new style as modifying data at step S4 and then proceeds to step S5 where a determination is made as to whether it has been instructed that the thus-generated tweak style data should be saved. If answered in the negative at step S5, the CPU 1 goes to step S7, but if answered in the affirmative, the CPU 1 proceeds to step S6 in order to register the generated tweak style data into the RAM 3 together with a style name of the data. After step S6, the CPU 1 goes to step S7.

At step S7, in accordance with instructing data in the tweak style, the accompaniment style data corresponding to the reference style are modified so as to generate modified accompaniment style data. Then, at next step S8, a determination is made as to whether it has been instructed that the thus-generated modified accompaniment style data should be saved. If answered in the affirmative at step S8, the CPU 1 proceeds to step S9 in order to save the generated modified accompaniment style data as custom style data into the external storage device 9, and then goes to step S10 to execute the reproduction process based on the modified accompaniment style data and then terminates the accompaniment style mode processing.

Through the above-described operations, any desired one of the existing accompaniment style data set can be designated and reproduced, modified accompaniment style data can be generated using modifying data (including tweak style) and then reproduced and saved, and also tweak style data can be generated and registered. Further, selection of desired tweak style data can be made through same user's operation as in the case of selection of desired accompaniment style data.

The present invention should not be interpreted as limited to the above-described embodiments, and various modifications are possible without departing the basic concepts of the present invention as follows.

The accompaniment style data to be modified may be supplied from a floppy disk, CD-ROM or the like provided in the external storage device, rather than being preset in the ROM. Further, the custom style data may either be temporarily saved in the RAM or saved in the external storage device.

Whereas the maximum velocity value in the dynamics parameters has been described as "100", it may be any suitable value. Further, whereas the modification rate in the dynamics parameters has been described as being in the range of 0–2, it may be in any other value range. Furthermore, modification of the velocity value using the dynamics parameters may be executed in any other manner than the above-mentioned; for instance, the velocity value modification may be executed by adding a value, given as a parameter, to an original velocity value or by multiplying an original velocity value by a modification rate given as a parameter.

The second and third embodiments have been described as repetitively reading out one accompaniment style data in relation to one modifying data set, so as to generate long modified accompaniment style data. Such a process for generating modifying data from accompaniment style data is also applicable to the case where a modifying groove template is formed from a groove template. For example, in this case, modifying groove data is first generated, then a groove template is set to instruct modification of a parameter value and reference thereto in the modifying data, and then a given groove template is repetitively read out for a designated reference period and modified in accordance with the parameter modification instruction to thereby generate a modified groove template. Where a plurality of reference groove templates are employed, the modification is carried out in the same manner as in the third embodiment.

Moreover, whereas the fourth embodiment has been described above in relation to the case where various style names are displayed in response to selection of the accompaniment style mode, selection of a desired style may be made directly by activating one of predetermined selecting operators, such as buttons, to which given styles are allocated.

The today's most popular scheme for creating an accompaniment pattern sequence for a piece of music may be the one based on selection of a plurality of chords, accompaniment style data, etc. Such an accompaniment pattern sequence may, however, be created on the basis of selection of modifying data sets in stead of accompaniment style data.

The present invention may be embodied as other types of electronic musical instrument than the keyboard-type, such as an electronic stringed instrument. Further, the present invention may be embodied as, rather than an integrated-type electronic musical instrument containing an automatic accompaniment function as described, a discrete-type electronic musical instrument where a tone generator module and sequencer provided separately from each other are connected such as via MIDI and/or network communication means.

The present invention may also be implemented by a combined use of a personal computer and software application program, in which case the application software program may be stored on a recording medium such as a magnetic disk, optical disk and semiconductor memory and may be supplied to the personal computer directly or via a communication network.

The performance data in the accompaniment style data may be in any desired format such as: the "event plus relative time" format where an occurrence time of a performance event is expressed by an elapsed time from a preceding event; the "event plus absolute time" format where an occurrence time of a performance event is expressed by an absolute time within a music piece or measure; the "pitch (rest) plus note length" format where the performance data is expressed by a combination of pitch and length of a note or by a combination of rest and its length; and the so-called "solid" format where a memory location is allocated for each minimum resolution unit of a performance and each performance event is stored at one of the memory locations corresponding to an occurrence time of the event.

Furthermore, an automatic performance tempo may be changed in any desired manner; for example, it may be changed by varying a tempo clock (interrupt signal) frequency, modifying a timing data value while maintaining a constant tempo clock frequency or varying a value used to count timing data per operation.

The accompaniment pattern data may be in a format where data for a plurality of channels are stored together in a mixed condition or in a format where data for each channel is stored in a separate track.

Moreover, the tone generator circuit may employ any of the conventionally-known tone generating methods, such as the waveform memory method, FM method, physical model method, harmonic synthesis method, formant synthesis method, and analog synthesizer method based on a combined use of VCO, VCF and VCA. The tone generator circuit may be implemented by a combination of a DSP and microprograms or may be implemented by software using a combination of a CPU and tone generating program, rather than by dedicated hardware. Where it is desired to provide a tone generator having a plurality of tone generating channels, only one tone generating circuit may be used on a time divisional basis, or a plurality of tone generating circuits may be provided in corresponding relations to the tone generating channels.

The control programs may be prestored in a hard disk device rather than in a ROM, in which case, by just loading the programs into the RAM, the CPU can operate in exactly the same way as where the control programs is stored in the ROM. This alternative arrangement will greatly facilitate version-up of the control programs, addition of a new control program or the like.

Where a CD-ROM drive is employed as the external storage device, it reads out the control programs and various data from a CD-ROM installed therein and the read-out control programs and data are then stored into a hard disk device. This alternative arrangement will also greatly facilitate version-up of the control programs, addition of a new control programs or the like.

Furthermore, the automatic accompaniment control programs, accompaniment style data and modifying data may be downloaded by use of a communication interface. The communication interface is connected to a communication network, such as a LAN (Local Area Network), Internet and telephone line network, so that it is connected with a server computer via the communication network. Where the control programs and various data are not stored in a hard disk device, this communication interface is used to download them from the server computer. In such a case, the electronic musical instrument, as a "client", sends a command requesting the server computer to download the programs and data by way of the communication interface and communication network. In response to the command, the server computer delivers the requested control programs and data to the electronic keyboard instrument via the communication network, and the musical instrument, in turn, receives and stores the control programs and data into the hard disk device, which completes the downloading.

In summary, the automatic accompanying device for executing an automatic accompaniment on the basis of accompaniment style data according to the present invention is characterized in that modification instructing data for modification of accompaniment style data and modifying data including style designating data for designating desired accompaniment style data are stored separately from the accompaniment style data and also that the particular accompaniment style data designated by the style designating data is modified in accordance with the modification instructing data so as to generate modified accompaniment style data. With such an arrangement, the modifying data can be handled independently of existing accompaniment style data, so that it is only necessary to generate different kinds of the modifying data in order to generate different kinds of modified accompaniment style data. As a result, the automatic accompanying device of the present invention permits generation of long accompaniment style data and therefore can provide an automatic accompaniment full of variety.

The automatic accompanying device of the present invention is also characterized in that if a time length of modification instructing data is greater than that of particular accompaniment style data, the particular accompaniment style data is repetitively modified and thus long accompaniment style data can be generated with ease. It is also possible to generate, from a plurality of original accompaniment style data, long accompaniment style data full of variety.

The automatic accompanying device of the present invention is also characterized by the provision of existing-accompaniment-style selecting operators and modifying-data selecting operators. Thus, an automatic accompaniment based on accompaniment style data can be carried out by activation of one of the accompaniment-style selecting operators, and similarly an automatic accompaniment based on modified data can be carried out by activation of one of the modifying-data selecting operators.

What is claimed is:

1. An automatic accompanying device comprising:

an accompaniment style data storage section having stored therein one or more accompaniment style data each including performance data for an automatic accompaniment;

a modifying data storage section having stored therein one or more modifying data sets each including style designating data for designating any one of the accompaniment style data stored in said accompaniment style data storage section and modification instructing data for modifying contents of the accompaniment style data designated by the style designating data;

a readout section that reads out one of the modifying data sets from said modifying data storage section; and an accompaniment style data generation section that reads out one of the accompaniment style data in response to the style designating data included in the modifying data set read out by said readout section and modifies contents of the read-out accompaniment style data in accordance with the modification instructing data included in the read-out modifying data set, so as to generate modified accompaniment style data.

2. An automatic accompanying device as recited in claim 1 which further comprises:

a selection section that selects an accompaniment style to be performed; and a performance execution section that when an existing accompaniment style is selected, reads out one of the accompaniment style data, corresponding to the accompaniment style selected by said selection section, from said accompaniment style data storage section, and wherein when a modified accompaniment style is selected by said selection section, said readout section reads out one of the modifying data sets and said performance execution section generates an automatic accompaniment tone in accordance with the modified accompaniment style data generated by said accompaniment style data generation section.

3. An automatic accompanying device comprising:

an accompaniment style data storage section having stored therein one or more accompaniment style data each including performance data for an automatic accompaniment;

a modifying data storage section having stored therein one or more modifying data sets each including style designating data for designating any one of the accompaniment style data stored in said accompaniment style data storage section and modification instructing data for modifying contents of the accompaniment style data designated by the style designating data;

a readout section that reads out one of the modifying data sets from said modifying data storage section; and an accompaniment style data generation section that reads out one of the accompaniment style data in response to the style designating data included in the modifying data set read out by said readout section and modifies contents of the read-out accompaniment style data in accordance with the modification instructing data included in the read-out modifying data set so as to generate modified accompaniment style data, wherein when the modification instructing data indicates a modification for a performance time longer than one pattern cycle of the designated accompaniment style data, the designated accompaniment style data is repetitively reproduced to provide time-length-expanded accompaniment style data, and the time-length-expanded accompaniment style data is subjected to modification in accordance with the modification instructing data so that the modified accompaniment style data is generated in time-length-expanded form.

4. An automatic accompanying device comprising:

an accompaniment style data storage section having stored therein one or more accompaniment style data each including performance data for an automatic accompaniment;

a modifying data storage section having stored therein one or more modifying data sets each including style designating data for designating one or more of the accompaniment style data stored in said accompaniment style data storage section and modification instructing data for modifying contents of the accompaniment style data designated by the style designating data;

a readout section that reads out one of the modifying data sets from said modifying data storage section; and an accompaniment style data generation section that reads out first said accompaniment style data in response to the style designating data included in the modifying data set read out by said readout section and modifies contents of the read-out first accompaniment style data in accordance with the modification instructing data included in the read-out modifying data set so as to generate modified accompaniment style data, wherein when the modification instructing data indicates a modification for a performance time longer than one pattern cycle of the designated accompaniment style data, one or more second said accompaniment style data are further read out from said accompaniment style data storage section in response to the style designating data and said first and second accompaniment style data are coupled together to provide time-length-expanded accompaniment style data, and the time-length-expanded accompaniment style data is subjected to modification in accordance with the modification instructing data so that the modified accompaniment style data is generated in time-length-expanded form.

5. An automatic accompanying device comprising:

an accompaniment style data storage section having stored therein a plurality of accompaniment style data each including performance data for an automatic accompaniment;

a modifying data storage section having stored therein a plurality of modifying data sets each including style designating data for designating one or more of the accompaniment style data stored in said accompaniment style data storage section and modification instructing data for modifying contents of the accompaniment style data designated by the style designating data;

a first selecting operation section that selects any one of the accompaniment style data stored in said accompaniment style data storage section;

a second selecting operation section that selects any m one of the modifying data sets stored in said modifying data storage section;

a readout section that reads out one of the modifying data sets selected via said second selecting operation section from said modifying data storage section; and an accompaniment style data generation section that reads out first said accompaniment style data in response to the style designating data included in the modifying data set read out by said readout section and modifies contents of the read-out first accompaniment style data in accordance with the modification instructing data included in the read-out modifying data set, so as to generate modified accompaniment style data.

6. An automatic accompanying device as recited in claim 5 which further comprises a performance execution section, and wherein when one of the accompaniment style data is selected by said first selecting operation section, said performance execution section reads out the selected accompaniment style data from said accompaniment style data storage section so as to generate an automatic accompaniment tone based on the read-out accompaniment style data and when one of the modifying data sets is selected by said second selecting operation section, said performance execution section generates an automatic accompaniment tone in accordance with the modified accompaniment style data generated by said accompaniment style data generation section.

7. A method of generating a variation of accompaniment style data by use of an accompaniment style data memory having stored therein one or more accompaniment style data each including performance data for an automatic accompaniment, said method comprising the steps of:

selectively supplying a modifying data set including style designating data for designating any one of the accompaniment style data stored in said accompaniment style data memory and modification instructing data for modifying contents of the accompaniment style data designated by the style designating data; and reading out one of the accompaniment style data in response to the style designating data included in the modifying, data set supplied by the step of selectively supplying, and modifying contents of the read-out accompaniment style data in accordance with the modification instructing data included in the read-out modifying data set, so as to generate modified accompaniment style data.

8. A method of generating a variation of accompaniment style data by use of an accompaniment style data memory having stored therein one or more accompaniment style data each including performance data for an automatic accompaniment, said method comprising the steps of:

selectively supplying a modifying data set including style designating data for designating any one of the accompaniment style data stored in said accompaniment style data memory and modification instructing data for modifying contents of the accompaniment style data designated by the style designating data; and reading out one of the accompaniment style data in response to the style designating data included in the modifying data set supplied by the step of selectively supplying, and modifying contents of the read-out accompaniment style data in accordance with the modification instructing data included in the read-out modifying data set so as to generate modified accompaniment style data, wherein when the modification instructing data indicates a modification for a performance time longer than one pattern cycle of the designated accompaniment style data, the designated accompaniment style data is repetitively reproduced to provide time-length-expanded accompaniment style data, and the time-length-expanded accompaniment style data is subjected to modification in accordance with the modification instructing data so that the modified accompaniment style data is generated in time-length-expanded form.

9. A method of generating a variation of accompaniment style data by use of an accompaniment style data memory having stored therein one or more accompaniment style data each including performance data for an automatic accompaniment, said method comprising the steps of:

selectively supplying a modifying data set including style designating data for designating one or more of the accompaniment style data stored in said accompaniment style data memory and modification instructing data for modifying contents of the accompaniment style data designated by the style designating data; and reading out first said the accompaniment style data in response to the style designating data included in the modifying data set supplied by the step of selectively supplying, and modifying contents of the read-out first accompaniment style data in accordance with the modification instructing data included in the read-out modifying data set so as to generate modified accompaniment style data, wherein when the modification instructing data indicates a modification for a performance time longer than one pattern cycle of the designated accompaniment style data, one or more second said accompaniment style data are further read out from said accompaniment style data storage section in response to the style designating data and said first and second accompaniment style data are coupled together to provide time-length-expanded accompaniment style data, and the time-length-expanded accompaniment style data is subjected to modification in accordance with the modification instructing data so that the modified accompaniment style data is generated in time-length-expanded form.

10. A machine-readable recording medium containing a group of instructions of a program executable by a computer, said program allowing the computer to generate a variation of accompaniment style data by use of an accompaniment style data memory having stored therein one or more accompaniment style data each including performance data for an automatic accompaniment, said program comprising:

means for selectively supplying a modifying data set including style designating data for designating any one of the accompaniment style data stored in said accompaniment style data memory and modification instructing data for modifying contents of the accompaniment style data designated by the style designating data;

means for reading out one of the accompaniment style data in response to the style designating data included in the modifying data set supplied by the step of selectively supplying, and modifying contents of the read-out accompaniment style data in accordance with the modification instructing data included in the read-out modifying data set, so as to generate modified accompaniment style data.

11. A machine-readable recording medium containing a group of instructions of a program executable by a computer, said program allowing the computer to generate a variation of accompaniment style data by use of an accompaniment style data memory having stored therein one or more accompaniment style data each including performance data for an automatic accompaniment, said program comprising:

means for selectively supplying a modifying data set including style designating data for designating any one of the accompaniment style data stored in said accompaniment style data memory and modification instructing data for modifying contents of the accompaniment style data designated by the style designating data;

means for reading out one of the accompaniment style data in response to the style designating data included in the modifying data set supplied by the step of selectively supplying, and modifying contents of the read-out accompaniment style data in accordance with the modification instructing data included in the read-out modifying data set so as to generate modified accompaniment style data, wherein when the modification instructing data indicates a modification for a performance time longer than one pattern cycle of the designated accompaniment style data, the designated accompaniment style data is repetitively reproduced to provide time-length-expanded accompaniment style data, and the time-length-expanded accompaniment style data is subjected to modification in accordance with the modification instructing data so that the modified accompaniment style data is generated in time-length-expanded form.

12. A machine-readable recording medium containing a group of instructions of a program executable by a computer, said program allowing the computer to generate a variation of accompaniment style data by use of an accompaniment style data memory having stored therein one or more accompaniment style data each including performance data for an automatic accompaniment, said program comprising:

means for selectively supplying a modifying data set including style designating data for designating one or more of the accompaniment style data stored in said accompaniment style data memory and modification instructing data for modifying contents of the accompaniment style data designated by the style designating data; and means for reading out first said the accompaniment style data in response to the style designating data included in the modifying data set supplied by the step of selectively supplying, and modifying contents of the read-out first accompaniment style data in accordance with the modification instructing data included in the read-out modifying data set so as to generate modified accompaniment style data, wherein when the modification instructing data indicates a modification for a performance time longer than one pattern cycle of the designated accompaniment style data, one or more second said accompaniment style data are further read out from said accompaniment style data storage section in response to the style designating data and said first and second accompaniment style data are coupled together to provide time-length-expanded accompaniment style data, and the time-length-expanded accompaniment style data is subjected to modification in accordance with the modification instructing data so that the modified accompaniment style data is generated in time-length-expanded form.

* * * * *